United States Patent [19]

Freese et al.

[11] 4,217,963

[45] Aug. 19, 1980

[54] BULLDOZER BLADE ANGLE SLIDE MECHANISM

[75] Inventors: Gary P. Freese, Joliet; James A. Olthoff, South Holland, both of Ill.

[73] Assignee: Caterpillar Tractor Co., Peoria, Ill.

[21] Appl. No.: 859,771

[22] Filed: Dec. 12, 1977

[51] Int. Cl.[3] ..... E02F 3/76

[52] U.S. Cl. ..... 172/804; 403/108

[58] Field of Search ..... 172/804, 805, 806, 807, 172/801, 803; 403/108; 248/354 P, 354 L, 407

[56] References Cited

U.S. PATENT DOCUMENTS

| | | | |
|---|---|---|---|
| 1,994,980 | 3/1935 | Cook | 248/407 X |
| 2,777,660 | 1/1957 | Albrecht | 248/354 P |
| 3,628,612 | 12/1971 | Liess | 172/804 |
| 3,655,161 | 4/1972 | Schueler | 248/354 P |
| 3,656,559 | 4/1972 | Lennea | 172/805 |
| 3,662,838 | 5/1972 | Polzin | 172/804 |
| 3,674,096 | 7/1972 | Berg | 172/805 |
| 3,749,182 | 7/1973 | Rockwell | 172/804 |
| 4,023,624 | 5/1977 | Frisbee | 172/805 |

*Primary Examiner*—Richard J. Johnson

*Attorney, Agent, or Firm*—Wegner, Stellman, McCord, Wiles & Wood

[57] ABSTRACT

An angled bulldozer blade for an earthmoving machine is operatively connected to a slider assembly slidably carried on a rail fastened to each side arm of a C-frame. Removable pins engage with each slider assembly and pass into aligned apertures of a plurality of prelocated apertures in the rail to position the slider assembly for setting the blade in a desired angled position. Self-locking latches are provided for retaining the pins in position. Eight apertures in each side rail are located so as to provide five positions for the slider assembly.

7 Claims, 6 Drawing Figures

BULLDOZER BLADE ANGLE SLIDE MECHANISM

BACKGROUND OF THE INVENTION

1. Field of the Invention

This invention relates to angled bulldozer blades and, more particularly, to a slider plate assembly for positioning the thrust members of the blade adjusting mechanism.

2. Description of the Prior Art

Traditionally, bulldozer blades are angled in any one of several positions by means of thrust members carried by the blade being pivotally connected to any one pair of a plurality of bearings or brackets mounted on the side arms of a C-frame. To change the bulldozer blade adjustment from, for instance, an angle-right to an angle-left position, the thrust members are disconnected from the appropriate pair of bearings or brackets and are physically moved to the desired other pair of bearings or brackets whereupon they are reattached.

Some time ago, various forms of slide assemblies were provided for slidable attachment to rails mounted on the side arms of the C-frame. Hydraulic cylinders have been connected between the C-frame and the slider assemblies for moving the slider assembly relative to the C-frame for changing the bulldozer blade angle.

Under certain conditions and for certain types of operations, the infinitely adjustable angling of the bulldozer blade proved to be unsatisfactory in that the power means, such as the hydraulic cylinders, were subject to such continuous stresses as to create service problems. Additionally, the use of hydraulic cylinders to angle the blade adds considerable expense and complexity to the bulldozer assembly.

Still another method of adjusting the angle of the bulldozer blade was to provide several pre-positioned openings in the C-frame such that the slider assembly connected to the thrust members could be moved into alignment with the openings in the C-frame and a pin dropped therethrough to position the slider assembly and the bulldozer blade in the desired angled position. The use of the single pin made it difficult to readjust the blade angle since there was no easy way to remove the pressure created on the pin by the slider assembly and bulldozer blade. To remove the pin generally required considerable manipulation of the blade to provide a substantially thrust-free condition on the pin. Although the system provided for stops to position the slide for insertion of the pin, such stops did not remove the pressure on the pin for removing the pin.

SUMMARY OF THE INVENTION

The present invention is directed to overcoming one or more of the problems as set forth above.

According to the present invention, the side arms of the C-frame are provided with rails upon which slider assemblies slide along the length of the side arms. The slider assemblies are connected through thrust members to the bulldozer blade. Two pins are aligned with each slider assembly and with aligned openings in the rails to position the slider assemblies on the C-frame and to set the angle of the bulldozer blade. The pins are retained in position on the slider assemblies. Each rail has a plurality of apertures which apertures are located relative to each other in such a way as to provide the slider assemblies and blade with a number of positions greater than one half the number of apertures in the rails. This is accomplished by locating some of the apertures for use in positioning the slider assembly in two different positions instead of one.

With a pin located at each end of each slider assembly, one of the pins will always have substantially no load applied to it by the slider assembly so that the unloaded pins can be removed and the angle of the blade can be changed.

BRIEF DESCRIPTION OF THE DRAWINGS

The details of construction and operation of the invention are more fully described with reference to the accompanying drawing which forms a part hereof and in which like reference numerals refer to like parts throughout.

In the drawing.

DESCRIPTION OF THE PREFERRED EMBODIMENT

Figures 1, 2, 3, 4, 5, 6:
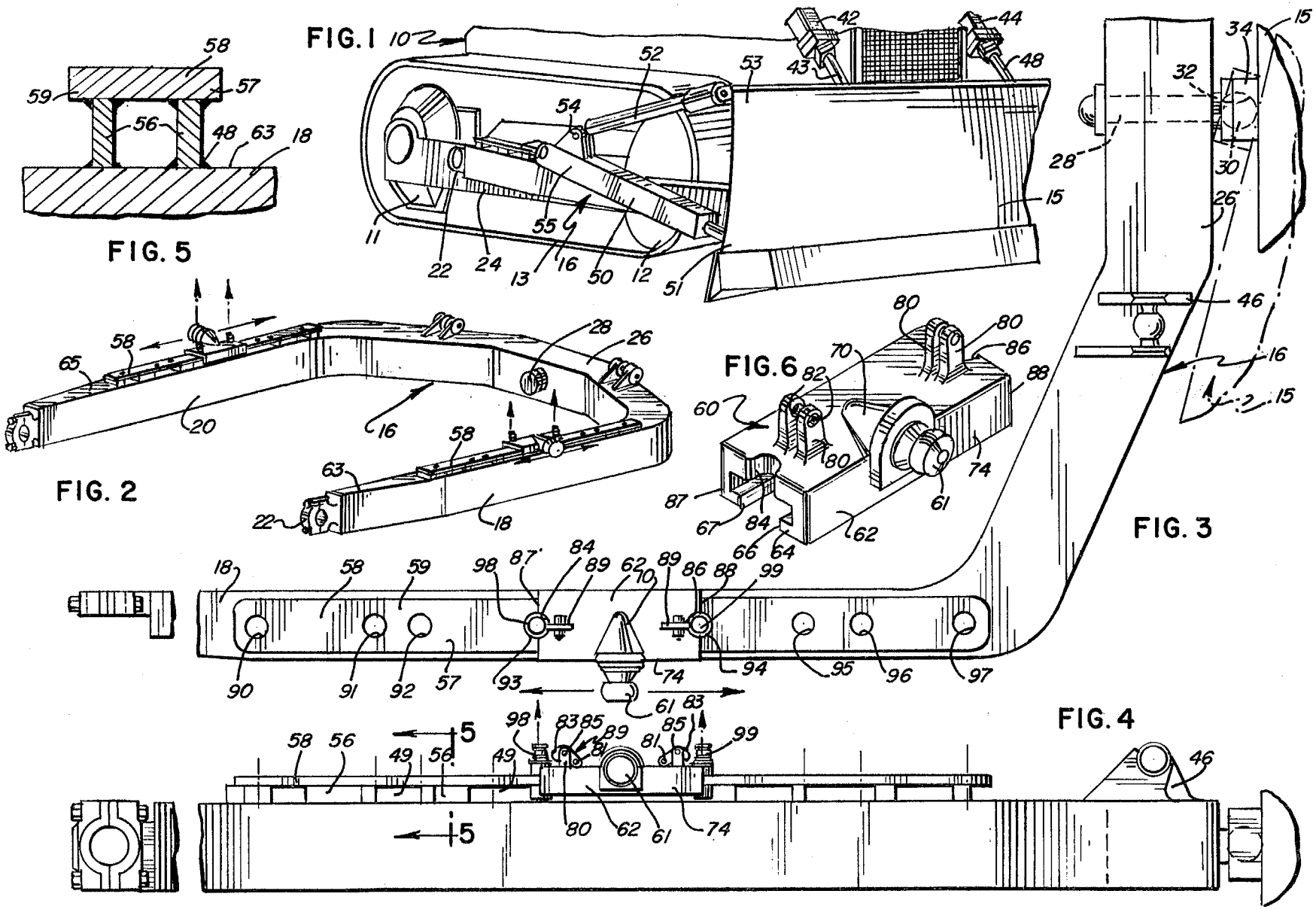
FIG. 1 is a partial perspective view, in elevation, of a tractor and angled bulldozer blade assembly incorporating the invention.
FIG. 2 is a perspective view of the improved C-frame showing the improved slider assemblies in position on the rails.
FIG. 3 is a partially enlarged plan view of one side of the C-frame of FIG. 2 showing the improved slider assembly on the rail.
FIG. 4 is an elevational view of the C-frame and slider assembly of FIG. 3.
FIG. 5 is an enlarged cross-sectional view taken along the line 5—5 of FIG. 4; and, FIG. 6 is a perspective view of the slider assembly incorporating some of the features of the invention.

Referring to the drawings and, more particularly to FIGS. 1 and 2 thereof, a tractor 10 is shown having a drive sprocket 11 and an idler wheel 12 about which an endless track 13 is positioned. One such track 13 is positioned on each side of the tractor. The tractor 10 supports an angled-bulldozer blade 15 by means of a C-frame 16 having laterally spaced apart side arms 18 and 20 which are located outboard of the tracks 13 and are pivotally connected at the rear end portions thereof by means of trunnion and socket connections 22 to the track roller frame 24. The midportion 26 of the forward end of the C-frame 16 has a connecting pin 28 passing through apertures therein. Said pin 28 has a forwardly projecting ball 30 which nests in a socket 32 formed in a bracket 34 mounted on the rear of the bulldozer blade 15. The ball 30 and socket 32 provide a universal joint or universal connection such that the blade can angle, tilt and pitch relative to the C-frame 16 and the tractor 10.

The C-frame 16 and bulldozer blade 15 are raised and lowered relative to the ground by means of a pair of cylinders 42 and 44 which can be hydraulically driven and are carried by opposite sides of the tractor 10 with the ends of the rods 43,45 of the cylinders 42,44 being connected to the brackets 46 carried by the upper surface of the midportion 26 of the C-frame 16. Actuation of the cylinders 42 and 44 will raise the C-frame 16 by pivoting it about the connections 22 which, in turn, will raise the bulldozer blade 15. A thrust member 50 has a tilt strut 52 pivotally connected at 54 to the upper rear portion 55 of said thrust member. The thrust members 50 are pivotally connected to the lower outboard corners 51 of each side of the bulldozer blade 15. Tilt struts 52 are connected to the upper outboard corners 53 of said blade 15. The rear portions 55 of each thrust member 50 is connected to a slider assembly 60 by means of a spherical ball 61 carried by a slide plate 62 which is slidably mounted on a T-shaped rail 58 secured to the top surfaces 63,65 of the side arms 18 and 20, respectively, of the C-frame 16.

The slider assembly 60 is comprised of said slide plate 62 having downwardly depending, inwardly projecting flanges 64 which are spaced apart at 67 to provide an undercut channel 66 running longitudinally the length of the slide plate 62. The midportion of the top of the slide plate 62 has an upwardly and sidewardly projecting rib 70 which has a conical protrusion 72 carrying said spherical ball 61. The ball 61 is disposed laterally outward from the side face 74 of the slide plate 62.

Two pairs of spaced apart upstanding ears 80 are attached to the top of the slide plate 62 near each longitudinal end portion thereof. Aligned apertures 82 are formed in said ears 80. A semicircular, vertically oriented cutout or indent 84,86 is formed in the respective longitudinal end faces 87,88 of the slide plate 62. A self-locking latch 89 is pivotally mounted by pin 85 between the upstanding ears 80 on each end of the slide plate 62. The latches 89 are comprised of a body portion through which the pivot pin 85 extends with a forwardly extending latch portion 83 overhanging the cutouts or indents 84,86 in the ends of the slide plate 62. A counterweighted rear part 81 is provided on the body of each latch 89 so as to cant or tilt the latch in a position with the counterweight part 81 in engagement with the slide plate 62 and the latch portion 83 overhanging the indents 84,86. The counterweighted part 81 may be lifted so that the outer surface of the latch portion 83 is aligned inboard of the semicircular cutouts or indents 84,86 in the end faces 87,88 of the slide plate 62.

The channel 66 of the slide plate 62 receives the overhanging edge portions 57,59 of the rails 58 carried by the side arms 18 and 20 of the C-frame 16. The rails 58 are supported in spaced apart relationship to the top surfaces 63,65 of said side arms 18,20 by the spaced apart legs 56 which are welded at 48 to said top surface 63,65 and to the undersurface of the rails 58. The legs 56 are not continuous throughout the length of the rails 58, but have spaces 49 along the length of the rails which are intended to facilitate keeping dirt and other foreign matter from accumulating excessively between the undersurface of the rail 58 and the top surface of the side arms 18,20.

A plurality of openings or apertures 90,91,92, 93,94,95,96,97 are formed through the rails 58, which apertures fall between the legs 56 of the supports for the rails 58. As will be noted, particularly in FIG. 3, the spacings between the apertures with respect to each other and with respect to adjacent apertures, is such as to establish a predetermined pattern. That is, starting from the left, in FIG. 3, the apertures are numbered 90, 91,92,93,94,95,96,97. The spacing between the centers of the apertures 90 and 92, 91 and 93, 93 and 94, 94 and 96, and 96 and 97 is equal to each other and is equal to the spacing between the centers about which the cutouts or indents 84,86 in the end faces 87,88 of the slide plate 62 are formed. It should be understood that the end faces 87,88 need not have indents 84,86 or may have extreme indents without departing from the invention.

As shown in FIG. 3, a pin 98 engages indent 84 and fits into aligned aperture 93 with a pin 99 engaging indent 86 and fits into aligned aperture 94, with the latch portion 83 of latches 89 overhanging pins 98,99 to prevent accidental removal of the pins. Due to the particular spacing of the apertures, certain apertures, for instance, apertures 93 and 94, are used for two different positions of the slide plate 62 or slider assembly 60 so that it is possible to have five positions of the slide plates 62 or slider assembly 60 making use of only eight apertures in the guide rails. In this way, the thrust members 50 and tilt struts 52 connected to the slide plates 62 or slider assembly and to the bulldozer blade 15 can be used to position the bulldozer blade in five different angled positions relative to the C-frame 16. The blade 15 will have an extreme angle left position, a modified angle left position, a straight across position, a slight angle right position and an extreme angle right position which, in total, gives a greater degree of flexibility to the angling positions of the bulldozer blade 15 wherein the bulldozer blade, when so angled, has a firm positive securement to the C-frame.

To adjust the angular position of the blade 15 from the straight across position, illustrated in FIGS. 2, 3 and 4, one pin 98 holding one slider assembly 60 on arm 18 and the pin 99 on the opposite end of the other slider assembly 60 on arm 20 are removed by lifting the counterweight portion 81 of the latching members 89 and lifting the pins 98,99 straight out. This is possible since the operator of the tractor can engage the bulldozer blade 15 with the ground or with an obstruction in such a way as to apply the pressure from the blade to the slider assembly 60 against one pin 99 on arm 18 on one side of the C-frame 16 and against the opposite pin 98 on the arm 20 on the other slider assembly. Thereafter, with the loading on the slider assemblies 60 and pins 99,98, as described, it is a simple matter to lift the unloaded pins 98,99, respectively, from the rail 58 and from the indents 84 and 86 in the slider assemblies. The pin 98 removed from arm 18 can then be dropped in any one of the remaining openings 90,91 in the rail 58 with the other pin 99 removed from arm 20, dropped in the appropriate one of the mating openings 96,97 on the other side of the C-frame. The slider assemblies 60 and the bulldozer blade 15 can then be moved on the rails 58 until the indent 84 on the slider assembly 60 on arm 18 engages with the replaced pin 98 and the indent 86 on slider assembly 60 on arm 20 engages with replaced pin 99 whereupon the remaining pin 99 in arm 18 and pin 98 in arm 20 now removed and replaced in the indents 86,84 and the aligned openings in the rails whereupon the slider assemblies 60 and the bulldozer blade 15 are locked in the new angled position. In the event there are no indents 84,86 in the slide plates 62, the pins 98,99 will be located in contact with or closely adjacent the end faces 87,88 of said plates. Operators become skilled in knowing which direction they want to angle the blade so that they can load the blade and the slider assemblies 60 to make it possible to remove the pins on the appropriate ends of the slide plates 62 so that the pins can be moved to the appropriate opening for changing the angle of the blade in the direction desired as set forth hereinabove.

The use of two vertical pins on each arm, which pass only through the guide rails, provide a very stable positioning of the slider assemblies 60 and the bulldozer blade 15 and since the apertures in the rail do not extend down into the C-frame 16, the C-frame is not weakened by the drilling of a large number of openings therein. It should be understood that the pins 98,99 and the apertures in the rails do not have to be vertical as illustrated, but could be oriented in another direction, such as horizontal, without departing from the invention. In addition, the use of the two pins for each slider assembly 60 makes it possible to remove one pin from each rail for positioning the slider assemblies relative to the C-frame. By locating the openings in the rails in the particular manner set forth whereby selected apertures can be used for positioning the slider assemblies in more than one position, it is possible to provide the slider assembly and blade with more positions, thereby making use of a less number of openings in the rail. The example given, shows eight openings in the rail for five positions for the bulldozer blade, it being understood that more or less openings could be used to locate more or less positions, the number of positions being equal to more than one-half the number of openings in the rail.

The embodiment of the invention in which an exclusive property or privilege is claimed is defined as follows:

1. An angle bulldozer blade for a tractor comprising:

a tractor;

a C-frame having side arms disposed about the tractor and pivotally connected thereto;

an angle bulldozer blade pivotally mounted to the midportion of said C-frame;

an elongated guide rail including a series of apertures carried by each of said side arms and extending along the same;

a pair of slides, one for each rail, slidably mounted on the corresponding rail;

thrust members interconnecting each of said slides and said blade;

first and second stop pins removably received in the apertures in each of said rails in locations spaced from each other, each first stop pin being receivable in an aperture in the corresponding rail for allowing slide movement in one direction on the corresponding rail while precluding movement in the opposite direction, each second stop pin being receivable in another aperture in the corresponding rail for precluding movement of said slide in said one direction while allowing movement of said slide in said opposite direction, each of said slides and the corresponding first and second stop pins being constructed and arranged so that when the slide is forcibly engaged with one of said stops, the other of said stop pins is not subject to force by engagement with the slide and may be easily removed from its aperture and relocated on said rail, and vice versa;

each of said rails have eight apertures therein with two of said apertures in each rail being usable twice to position the slide means in two different positions so that the eight apertures result in five positions of the slide means relative to the rails.

2. An angle bulldozer blade for a tractor comprising:

a tractor;

a C-frame having side arms disposed about the tractor and pivotally connected thereto;

an angle bulldozer blade pivotally mounted to the midportion of said C-frame;

an elongated guide rail including a series of apertures carried by each of said side arms and extending along the same;

a pair of slides, one for each rail, slidably mounted on the corresponding rail;

thrust members interconnecting each of said slides and said blade;

first and second stop pins removably received in the apertures in each of said rails in locations spaced from each other, each first stop pin being receivable in an aperture in the corresponding rail for allowing slide movement in one direction on the corresponding rail while precluding movement in the opposite direction, each second stop pin being receivable in another aperture in the corresponding rail for precluding movement of said slide in said one direction while allowing movement of said slide in said opposite direction, each of said slides and the corresponding first and second stop pins being constructed and arranged so that when the slide is forcibly engaged with one of said stops, the other of said stop pins is not subject to force by engagement with the slide and may be easily removed from its aperture and relocated on said rail, and vice versa;

means carried by said slides for preventing said pins from being accidentally removed.

3. An angle bulldozer blade for a tractor comprising:

a tractor;

a C-frame having side arms disposed about the tractor and pivotally connected thereto;

an angle bulldozer blade pivotally mounted to the midportion of said C-frame;

an elongated guide rail including a series of apertures carried by each of said side arms and extending along the same;

a pair of slides, one for each rail, slidably mounted on the corresponding rail;

thrust members interconnecting each of said slides and said blade;

first and second stop pins removably received in the apertures in each of said rails in locations spaced from each other, each first stop pin being receivable in an aperture in the corresponding rail for allowing slide movement in one direction on the corresponding rail while precluding movement in the opposite direction, each second stop pin being receivable in another aperture in the corresponding rail for precluding movement of said slide in said one direction while allowing movement of said slide in said opposite direction, each of said slides and the corresponding first and second stop pins being constructed and arranged so that when the slide is forcibly engaged with one of said stops, the other of said stop pins is not subject to force by engagement with the slide and may be easily removed from its aperture and relocated on said rail, and vice versa;

said guide rail has every aperture spaced from at least one other aperture by a distance slightly greater than the length of said slide means, and at least one of said apertures being spaced from two other apertures by a distance slightly greater than the length of said slide means.

4. An angle bulldozer blade for a tractor comprising:

a tractor;

a C-frame having side rails disposed about the tractor and pivotally connected thereto;

an angle bulldozer blade pivotally mounted to the midportion of said C-frame;

a pair of slides, one for each rail, slidably mounted on the corresponding rail;

thrust members interconnecting each of said slides and said blade;

first and second stops relocatably mounted on each of said rails and engageable with the corresponding slide, the first and second stops on a rail being spaced from each other, the first stop including means for allowing slide movement in one direction on the corresponding rail while precluding slide movement in the opposite direction, said second stop including means for precluding movement of said slide in said one direction on said rail while allowing movement of said slide in said opposite direction, each of said slides and the corresponding first and second stops being constructed and arranged so that when said slide is forcibly engaged with one of said stops, the other of said stops is no subject to force by engagement with the slide and may be easily relocated on said rail, and vice versa;

means on said slides for preventing said stops from being accidentally removed from said slides.

5. An angle bulldozer blade for a tractor comprising:

a tractor;

a C-frame having side arms disposed about the tractor and pivotally connected thereto;

an angle bulldozer blade pivotally mounted to the mid portion of said C-frame;

an elongated guide rail including a series of apertures carried by each of said side arms and extending along the same;

a pair of slides, one for each rail, slidably mounted on the corresponding rail;

thrust members interconnecting each of said slides and said blade;

first and second stop pins removably received in the apertures in each of said rails in locations spaced from each other, each first stop pin being receivable in an aperture in the corresponding rail for allowing slide movement in one direction on the corresponding rail while precluding movement in the opposite direction, each second stop in being receivable pin another aperture in the corresponding rail for precluding movement of said slide in said one direction while allowing movement of said slide in said opposite direction, each of said slides and the corresponding first and second stop pins being constructed and arranged so that when the slide is forcibly engaged with one of said stops, the other of said stop pins is not subject to force by engagement with the slide and may be easily removed from its aperture and relocated on said rail, and vice versa.

6. An angle bulldozer blade for a tractor comprising:

a tractor;

a C-frame having side rails disposed about the tractor and pivotally connected thereto;

an angle bulldozer blade pivotally mounted to the midportion of said C-frame;

a pair of slides, one for each rail, slidably mounted on the corresponding rail;

thrust members interconnecting each of said slides and said blade; and first and second stops relocatably mounted on each of said rails and engageable with the corresponding slide, the first and second stops on a rail being spaced from each other, the first stop including means for allowing slide movement in one direction on the corresponding rail while precluding slide movement in the opposite direction, said second stop including means for precluding movement of said slide in said one direction on said rail while allowing movement of said slide in said opposite direction, each of said slides and the corresponding first and second stops being constructed and arranged so that when said slide is forcibly engaged with one of said stops, the other of said stops is not subject to force by engagement with the slide and may be easily relocated on said rail, and vice versa.

7. A angle bulldozer blade for a tractor comprising:

a tractor;

a C-frame having side arms disposed about the tractor and pivotally connected thereto;

an angle bulldozer blade pivotally mounted to the midportion of said C-frame;

an elongated guide rail carried by each of said side arms and extending along the same;

a pair of slides, one for each rail, slidably mounted on the corresponding rail;

thrust members interconnecting each of said slides and said blade;

first and second stops removably mounted on each of said rails, the first and second stops on a rail being spaced from each other, the first stop including means for allowing slide movement in one direction on the corresponding rail while precluding slide movement in the opposite direction, said second stop including means for precluding movement of said slide in said one direction on said rail while allowing movement of said slide in said opposite direction, each of said slides and the corresponding first and second stops being constructed and arranged so that when said slide is forcibly engaged with one of said stops, the other of said stops it not subject to force by engagement with the slide and may be easily relocated on said rail, and vice versa.

* * * * *